US009890960B2

(12) United States Patent
Huts

(10) Patent No.: US 9,890,960 B2
(45) Date of Patent: Feb. 13, 2018

(54) WATER SAVING APPARATUS

(71) Applicant: Adam William Huts, Maffra (AU)

(72) Inventor: Adam William Huts, Maffra (AU)

(73) Assignee: Adam William Huts, Maffra (AU)

( * ) Notice: Subject to any disclaimer, the term of this patent is extended or adjusted under 35 U.S.C. 154(b) by 41 days.

(21) Appl. No.: 14/782,279

(22) PCT Filed: Feb. 7, 2014

(86) PCT No.: PCT/AU2014/000093
§ 371 (c)(1),
(2) Date: Oct. 2, 2015

(87) PCT Pub. No.: WO2014/121335
PCT Pub. Date: Aug. 14, 2014

(65) Prior Publication Data

US 2016/0084509 A1 Mar. 24, 2016

(30) Foreign Application Priority Data

Apr. 4, 2013 (AU) ..... 2013202532

(51) Int. Cl.
*F24D 17/00* (2006.01)
*E03B 1/04* (2006.01)

(52) U.S. Cl.
CPC ..... *F24D 17/0078* (2013.01); *E03B 1/048* (2013.01); *F24D 17/0094* (2013.01)

(58) Field of Classification Search
CPC ..... F24D 17/00; F24D 17/001; F24H 1/08; F24C 13/00; B60H 1/00314; B60H 2001/00307
See application file for complete search history.

(56) References Cited

U.S. PATENT DOCUMENTS 7,726,263 B2 * 6/2010 Ben-Ishai ..... F24H 1/185 122/20 A
8,191,513 B2 * 6/2012 Krause ..... F24D 17/0078 122/20 R
9,151,021 B2 * 10/2015 Cuervo-Arango Y De Cachavera ..... F24D 17/0078
9,284,721 B2 * 3/2016 Gilbert ..... E03C 1/0408
(Continued)

FOREIGN PATENT DOCUMENTS

GB 588729 6/1947

OTHER PUBLICATIONS

International Search Report dated Mar. 6, 2014 for International Application No. PCT/AU2014/000093, filed Feb. 7, 2014.

*Primary Examiner* — Gregory A Wilson
(74) *Attorney, Agent, or Firm* — Knobbe, Martens, Olson & Bear, LLP

(57) ABSTRACT

A water saving apparatus for use with a hot water system, the apparatus being sized and shaped for installation proximate one or more water outlet fixtures for delivery of heated water from the hot water system for use. The apparatus comprises an insulated reservoir having an inlet and an outlet to enable the reservoir to be installed in line with the flow of heated water from the hot water system to the one or more fixtures to store a quantity of heated water. Water that has cooled in the hot water pipe between the hot water system and the reservoir mixes with the stored heated water in the reservoir as water flows from the hot water system to the water outlet fixture.

20 Claims, 12 Drawing Sheets

(56) References Cited

U.S. PATENT DOCUMENTS

| | | | | |
|---|---|---|---|---|
| 9,316,403 | B2 * | 4/2016 | Haws | F24D 3/1041 |
| 2005/0166313 | A1 * | 8/2005 | Permenter | F24H 1/202<br>4/625 |
| 2008/0115839 | A1 * | 5/2008 | Acker | F24D 17/0031<br>137/337 |
| 2008/0230126 | A1 * | 9/2008 | Acker | F24D 17/0031<br>137/337 |
| 2011/0000972 | A1 * | 1/2011 | Sinclair | E03B 1/04<br>236/93 R |

* cited by examiner

WATER SAVING APPARATUS

TECHNICAL FIELD

The field of the invention is water saving systems, methods and apparatus aiming to reduce water wasted in domestic use.

BACKGROUND

Increasing populations and climate change are causing ever increasing strains on water resources and drinking water supplies. In recent times this has resulted in water restrictions for households and businesses and increasing prices. It is therefore desirable to conserve water resources and avoid waste. Particularly in domestic situations large volumes of water can be wasted during the simple act of washing using hot water and waiting for hot water supply, for example, showering or washing hands under running water.

Water saving systems have been developed to recover and reuse waste water, often referred to as to grey water systems. Where a grey water system is installed, all water used for washing can be recovered in the grey water system, including the clean water that goes down the drain while waiting for hot water. Some grey water systems perform some treatment of the waste water and others simply store the waste water for a secondary use. Due to health concerns restrictions are generally imposed on the use of grey water, for example limiting use to flushing of toilets, watering of gardens and maybe for laundry use. Installation and use may also be restricted to ensure that grey water will not enter storm water drains. Grey water systems can be expensive and complex to install; requiring significant space for a large grey water storage tank and pump and significant re-plumbing for effective collection and reuse of recycled water. Ongoing maintenance is also required, for example regular changing of filters and servicing of pumps.

Other systems have been devised to recover fresh water that would otherwise be wasted before this goes down the drain to be treated as waste water. Known systems utilize temperature sensitive valves in hot water pipes to divert water from hot water pipes until the water reaches a threshold temperature. The diverted water is diverted to a holding tank. The water from the holding tank can then either be redirected into cold water supply pipes or used for another purpose such as watering gardens or flushing of toilets, similar to grey water use. Such systems recover water before it is released from the tap for diversion into the cold water circulation or another purpose and thus require significant re-plumbing for installation. Further because these systems use temperature sensing valves they may require regular maintenance. There is a need for simpler low maintenance systems to reduce wasting water.

SUMMARY OF THE INVENTION

Aspects of the present invention provide a water saving apparatus for use with a hot water system, the apparatus being sized and shaped for installation proximate one or more water outlet fixtures for delivery of heated water from the hot water system for use, the apparatus comprising:

an insulated reservoir having an inlet and an outlet;

the inlet being arranged to be connectable to a hot water pipe which carries heated water from the hot water system and the outlet arranged to be connectable to a hot water pipe providing heated water to the one or more water outlet fixtures to enable the reservoir to be installed in line with the flow of heated water from the hot water system to the one or more fixtures to store a quantity of heated water whereby water that has cooled in the hot water pipe between the hot water system and the reservoir mixes with the stored heated water in the reservoir as water flows from the hot water system to the water outlet fixture.

In an embodiment at least the inlet can be provided with a one way valve arranged to allow water to flow into the reservoir and inhibit reverse flow of water from the reservoir to the hot water pipe. The outlet may also be provided with a one way valve.

In an embodiment the outlet is located in a lower portion of the reservoir. The inlet may be located in any of an upper, central or lower portion of the reservoir. Alternatively, the outlet may be located in a central or upper portion of the reservoir and the inlet located in any one of an upper, central or lower portion of the reservoir. In other embodiments the inlet and outlet may be located in the top and bottom of the reservoir or both located in the top or bottom of the reservoir.

The apparatus can include one or more structures arranged inside the reservoir to aid mixing of water entering the reservoir via the inlet with water in the reservoir before release via through outlet. In an embodiment at least one of the one or more structures is a fluid distributor connected to the inlet to allow fluid to flow therethrough and configured to control entry of water from the inlet into the reservoir.

In an embodiment the fluid distributor is configured to enable some heat exchange between the water flowing therethrough and the water in the reservoir before the water entering the reservoir mixes with the water in the reservoir.

In an embodiment the fluid distributor is configured such that water flowing therethrough enters the reservoir remote from the outlet.

In an embodiment the fluid distributor is configured to disperse the inflowing water throughout the reservoir. In an embodiment the fluid distributor comprises a body for water to travel therethrough, the body having a plurality of apertures to allow water to be released into the reservoir. In one embodiment the body is an elongate pipe with apertures distributed along the length of the pipe. The apertures can be distributed asymmetrically along the length of the pipe. Alternatively the apertures may be evenly distributed.

In an alternative embodiment the fluid distributor comprises a plurality of interconnected pipes.

In some embodiments a low heat conductivity material is used for the connection of the fluid distributor to the inlet The apparatus can include baffles arranged to aid mixing of water entering the reservoir via the inlet with water in the reservoir before release via through outlet. The baffles can be perforated.

In an embodiment of the apparatus the inlet and outlet are provided with insulated connecting fixtures to reduce heat loss from the reservoir. In an embodiment the inlet and outlet are provided with dual component fittings, each comprising a proximate component for respective connection to the reservoir, and a distal component for connection to the respective hot water pipe or water output pipe, the connection between the proximate and distal components of the fittings being insulated and configured to inhibit water flow between the reservoir and external pipes in the absence of water flow from the water outlet fixture.

DETAILED DESCRIPTION

Figure 1:
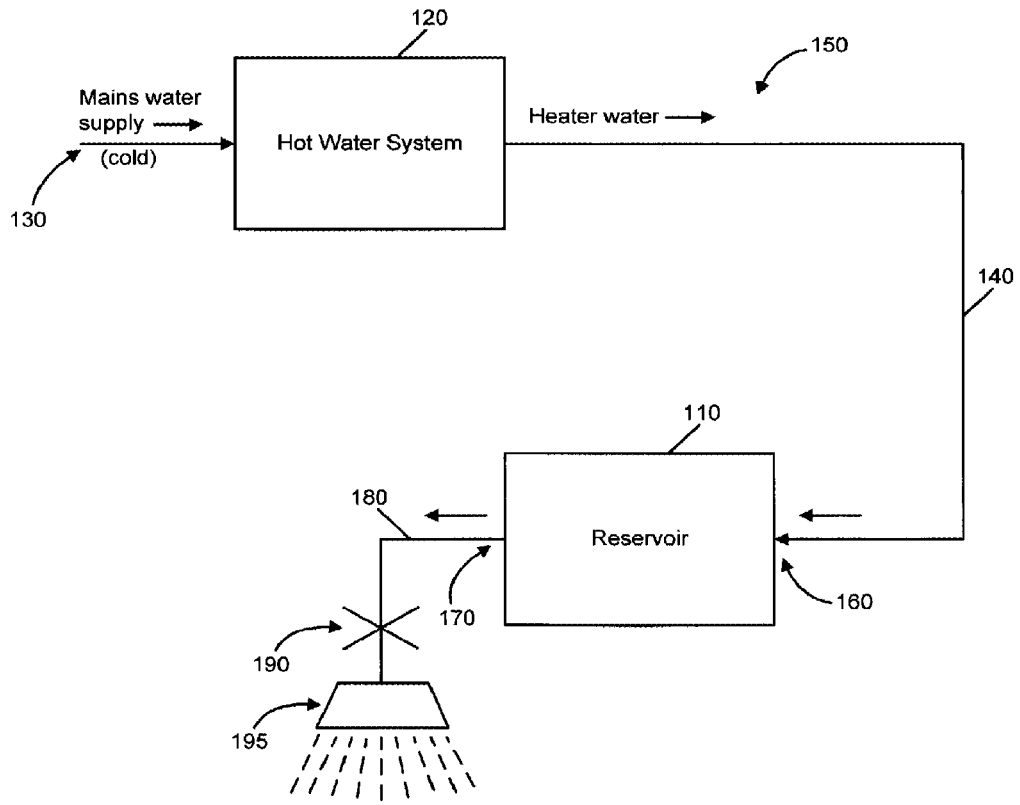
FIG. 1 is a block diagram representing an application of an embodiment of the present invention.

Embodiments of the present invention provide a water saving apparatus for use with a hot water system. A block diagram of an embodiment is shown in FIG. 1. The apparatus is sized and shaped for installation proximate one or more water outlet fixtures, such as shower heads 195 or faucets for delivery of heated water from the hot water system 120 for use, and comprises an insulated reservoir 110 having an inlet 160 and an outlet 170. The inlet 160 is arranged to be connectable to a hot water pipe 140 which carries heated water 150 from the hot water system 120. The inlet 160 can be provided with a one way valve to enable water to flow in the direction from the hot water system 120 into the reservoir 110 only. The outlet 170 is arranged to be connectable to hot water pipe 180 providing heated water to the one or more water outlet fixtures 195. This arrangement enables the reservoir 110 to be installed in line with the flow of heated water 150 from the hot water system 120 to the one or more fixtures 195 to hold, in the reservoir 110, a quantity of stored heated water proximate the one or more water outlet fixtures 195 and provide heated water to the water outlet fixtures 195 via the reservoir 110. When one of the water outlet fixtures is operated to release heated water, then any water that has cooled in the hot water pipe 140 between the hot water system 120 and the reservoir 110 mixes with the stored heated water in the reservoir 110 as water flows from the hot water system 120 to the water outlet fixture 190. Thus reducing the waiting time for heated water, as cooled water from the pipe 140 is mixed with stored heated water in the reservoir 110, rather than a user needing to wait for the cooled water to be purged from the pipe 140, and typically run down the drain, before heated water is provided.

The reservoir 110 vessel may be constructed of any suitable material, for example stainless steel, copper, fibreglass or plastic. Composite materials may also be used to construct the reservoir. The vessel is insulated to aid heat retention in the stored water. In an embodiment the vessel may be insulated by providing an outer layer of insulation. Alternatively the vessel may have a double walled construction to provide vacuum insulation, an insulation layer of air or other gas (for example argon, nitrogen or mixed gases having heat insulating properties) or insulating material between the walls. Different materials may be used for internal and external walls of a double walled vessel. Alternatively, multiple layers of different materials may be used for insulating the reservoir. In another embodiment the reservoir vessel is contained within an insulated housing. It should be appreciated by a skilled person that any suitable material may be used. The reservoir vessel may take on a variety of forms with its shape and volume varying based on requirements for different installations. For example, the vessel can be shaped to accommodate restrictions in installation of the reservoir proximate the water outlet fixture. For example, relatively tall and flat shapes may be used for installation within a cavity wall or short squat shapes may be more suitable for location within a roof space.

In embodiments for use with pressurised hot water systems the reservoir vessel will be formed appropriately to comply with the pressure requirements. For example, the vessel may be cylindrically shaped to enable pressure requirements to be met. A cylindrical reservoir vessel may be housed within a reservoir casing of a different shape adapted for more easy handling and installation, for example oblong or box like. In such embodiments the inlet and outlet of the reservoir vessel inlet and outlet can be connected to inlet and outlet fittings that are accessible from the exterior of the casing to connect in line with the hot water pipe. Some embodiments may use inlet and outlet fittings for the reservoir that are internal to the casing, and may also be insulated within the casing, which are connected to externally accessible inlet and outlet fittings on the casing. The casing may be insulated in addition to or as an alternative to insulation of the reservoir vessel itself. The casing may carry any appropriate brackets and fittings for handling and installation. The casing may also support accessories such as pressure release valves, drainage/spill pan, drainage hose or fittings for holding such accessories. In alternative embodiments appropriate brackets and fittings may be provided on or attachable to the reservoir vessel directly.

It should be appreciated that any shape reservoir vessel may be used provided the appropriate pressure requirements can be met. The shape of the vessel may be influenced by the material used. For example it may be necessary for the vessel to have a cylindrical shape to meet pressure requirements when constructed using lightweight aluminium or plastics materials and for cost effective construction. Alternative embodiments using different materials and/or structural features may have different shapes and still fulfil pressure requirements. For example, oblong shapes may be used with appropriate materials and, if necessary, strengthening structures (such as ribs or internal lattices) of the reservoir vessel. Placement of inlet and outlet fittings for the reservoir vessel may also be influenced by the need to fulfil pressure requirements and all possible variations are contemplated within the scope of the present invention.

Embodiments of the reservoir may be configured for installation inside a wall or ceiling cavity so the reservoir is hidden from view. Alternative embodiments may be configured to be installed in a manner where the reservoir is visible, for example mounted on an interior wall above a shower or sink. Embodiments configured for visible installation may have an exterior reservoir housing shape and any accessories and fittings designed for aesthetics as well as function.

The size of the reservoir may vary between embodiments. A minimum reservoir size for an installation may be selected based on the length of pipe 140 between the hot water system and reservoir and therefore the maximum volume of cold water anticipated to be mixed with the contents of the reservoir and provide heated water at a reasonable temperature at the water outlet fixture. Alternatively the reservoir volume may be chosen based on requirements for maintaining biological safety of the stored water given the local conditions. Water stored in a smaller vessel will typically be totally refreshed more regularly than a larger vessel and therefore the risk of bacteria growing to unsafe levels will be lower for a smaller vessel. The actual maximum vessel size to minimise biological risk will vary based on many factors some of which include, level of biological contamination in original water supply, temperature the water is heated to initially, typical length of time water will be stored for the given installation, ambient temperature, type of insulation used etc. Each of these factors may vary from city to city and even household to household. In some countries the maximum size of a passive hot water storage vessel may be mandated by local health regulations or building codes. For example, in Australia regulations for control of Legionnaires disease restrict the size of hot water storage vessels to 10 liters unless actively heated. Prototype testing has shown that a vessel of this size can provide highly effective results. Other considerations for choice of reservoir size can include anticipated use and space. (Examples will be discussed in more detail in the following paragraphs.) As discussed in later examples, the reservoir may also be constructed in a manner which aids the mixing of water within the reservoir.

The inlet and outlet of the reservoir can be provided with fittings that are adapted for connecting the inlet and outlet to standard hot water pipes. For example, the inlet and outlet fittings may be suitable for establishing water tight connections directly with either copper or polyvinyl chloride (PVC) hot water piping. Alternatively the inlet and outlet may be connected to hot water pipes using adapters to accommodate differences is size between inlet and outlet fittings and hot water pipes. For example a reservoir may be provided with 20 mm inlet and outlet fittings and adapters used for connecting these fittings to 15 mm water pipes. The reservoir input and output fixtures can be designed for minimal re-plumbing for installation. Inlet and outlet fitting may be constructed to minimise heat loss for the reservoir via the fittings. For example, the fittings may be insulated, made using low heat conductivity materials, use internal valve structures, such as double walled valves, to minimise heat transfer between water on each side of the valve. Any suitable fitting material or structure may be used and all variations are considered within the scope of the present invention.

Figure 2A:
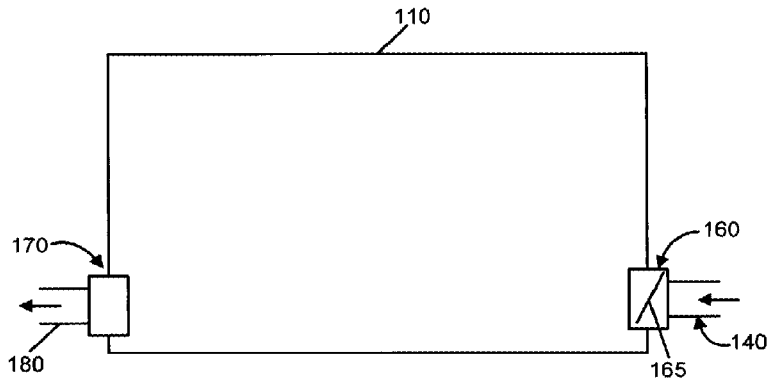
FIGS. 2 to 7 are block diagrams of various embodiments of the present invention.
Figure 2B:
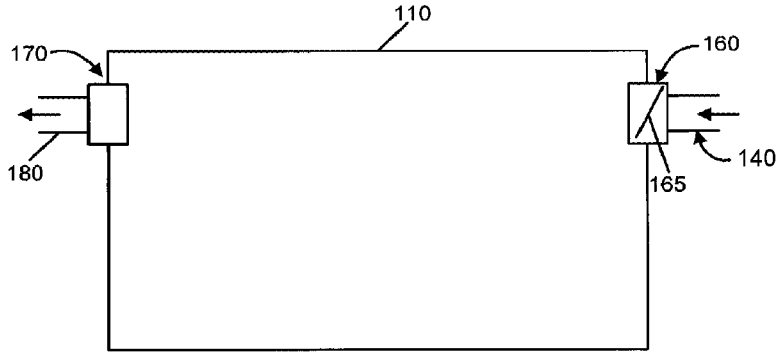

In an embodiment, the inlet fitting 160 has a built in non-return check valve 165 (as illustrated in FIGS. 2*a* and 2*b*) which allows water to flow into the reservoir from the hot water pipe but stops reverse flow. Any suitable non-return valve configuration may be used. It should be appreciated that in some embodiments the non-return valve may be a standard plumbing non-return valve which is a separate component from the inlet fitting 160 that is connectable to the inlet fitting 160. The output fitting 170 may also be provided with a one way check valve. The one way valves on the inlet and outlet can be optional. The reservoir 110 is connected, using the inlet 160 and outlet 170 fittings, to be in line with the flow of water from the hot water system to the water outlet fixture such that cooled water in the pipe 140 will mix with heated stored water in the reservoir as the hot tap 190 is open to draw off water by the pipe 180. When the hot tap 190 is closed, heated water will be held in the insulated reservoir 110. Use of a one way valve on the inlet 160 inhibits exchange of water from the reservoir with water cooling in the water supply pipe 140 while water is not flowing, thus aiding heat retention. The one way check valve in the inlet 160 can also be configured to aid heat retention by reducing heat transfer between the water stored in the reservoir and water cooling in the pipe 140. Further, most hot water systems are pressurised (mains pressure hot water systems) and this pressurisation can also aid heat retention in the reservoir. Check valves may also be provided at both the inlet and outlet which inhibit flow in both directions while closed and act to minimise heat transfer between water on either side of the inlet or outlet, to inhibit heat loss form the reservoir via the inlet and outlet.

Pipes 140 used to deliver water from a hot water system storage tank 120 to water outlet fixtures such as taps and faucets are typically not insulated to minimize cost. In installations where the hot water system storage tank 120 is some distance away from the heated water outlet fixture, say a shower 195, the pipe 140 may hold a significant quantity of water which will cool while sitting in the pipe 140. A person having a shower will typically let cooled water run down the drain and be wasted while waiting for water hot enough to shower with.

The distance between a hot water tank 120 and a shower outlet 195 in a bathroom may vary from a few meters to over 25 meters depending on the design of the house and location of the hot water system 120. Particularly where a single hot water system is used to provide water for more than one bathroom, or wet areas such as kitchen and laundry are not located near the bathroom, the hot water system may be a considerable distance from a shower outlet in at least one bathroom. It is common for at least 8-12 meters of pipe to be between a hot water system and shower in an average home, this represents around 3-7 liters of water depending on the size of the pipe 140. This water will typically be wasted at least once every day representing a waste of around 1100 to 2555 liters per year. However, this figure will vary from household to household depending on a number of factors, such as the number of bathrooms, time between showers, length and diameter of piping between the hot water system and showers, and piping material. Using the system of the present invention the amount of waste water for a household can be significantly reduced.

An example of the operation of an embodiment of the invention will now be discussed in more detail with reference to FIG. 1. In this example, the reservoir 110 is installed upstream of a shower 195 and its respective tap 190 in a roof cavity as close as practical to the hot tap 190. The reservoir 110 is installed as close as practical to the hot tap 190 to minimize the length of pipe 180 between the reservoir and the hot tap. The hot water system 120 receives cold water via the main supply 130 and heats this water. The temperature of the hot water system 120 is typically set by the householder using a thermostat, so the temperature can vary, for example householders will typically set the thermostat for their hot water service somewhere between 60° C. and 80° C. Australian building codes regulate the temperature for hot water supplied to bathrooms to 50° C. in new buildings. In such cases the hot water system 120 will have a mix down mechanism to mix hot water output from the heating tank with cold water to reduce the temperature to around 50° C. as the water is supplied to the bathroom hot water supply pipe 140. (The mix down mechanism is not shown in the simple block diagram of FIG. 1). In buildings constructed prior to introduction of bathroom temperature regulations the water supplied to the pipe 140 may be hotter as no mix down is required. For this example we will consider the heated water 150 is supplied to pipe 140 at a temperature of 50° C.

Operation of the hot tap 190 draws water from the reservoir 110 via the pipe 180 which, in turn, causes heated water 150 to flow from the hot water system 120 via the pipe 140 toward the reservoir 110. As water is drawn off from the reservoir 110 via the pipe 180 initially, the water entering the reservoir 110 from pipe 140 will be water that has cooled sitting in the pipe 140 since the shower was last operated. Within the reservoir 110 this cooled water mixes with the stored water in the reservoir before being drawn off from the outlet 170.

The only cold water the user may experience is a small amount of water from the pipe 180 between hot tap 190 and the outlet 170 which may be barely perceptible to the user so it appears that the heated water is supplied instantaneously.

Initially, the water from the pipe 140 being mixed with the water in the reservoir 110 is cooled from sitting in the pipe so the temperature of the water in the reservoir will drop as a result of this mixing. As the pipe 140 is flushed of cooled water by freshly heated water 150 the temperature of the water being mixed in the reservoir 110 will increase. This decrease and increase in water temperature will be gradual by virtue of the mixing and thus a shock of rapidly going from very cold to very hot water is avoided. This can be unpleasant and also dangerous, particularly for children or elderly persons with delicate easily scalded skin.

Typical flow rate of a shower is 9 liters per minute which is generally a mix of cold water and hot water, depending on the length of the hot water piping 140 from the main hot water system the amount of cold water entering the reservoir will vary. Considering a scenario of around to 5 to 7 liters of cooled water sitting in the pipe 140 it should be appreciated, that without having heated water stored in the reservoir approximate the shower 195 a person would have waited for around a minute with fresh water running down the drain before having hot water to shower with. Using an embodiment of the present invention heated water is provided at the shower 195 almost instantaneously even though it may take 1 to 2 minutes before the 5-7 liters of cooled water is flushed from the pipe 140 and fresh hot water arrives at the reservoir 110. After the cooled water is flushed from the pipe 140 the water in the reservoir 110 is refreshed with freshly heated water 150 flowing from the hot water system 120.

The minimum water temperature ($T_{min}$) due to mixing of water from the pipe 140 with water stored in the reservoir 110 can be estimated using equation 1 below $$\frac{(V_P \times T_{Pmin}) + ((V_R - V_P) \times T_{Rmin})}{V_R} = T_{min} \qquad \text{[Equation 1]}$$

Where $V_P$ is the volume of water in the pipe $T_{Pmin}$ is the temperature the water in the pipe has cooled to $V_R$ is the volume of water in the reservoir $T_{Rmin}$ is the temperature the volume of water in the reservoir has cooled to In an example of an embodiment for use with a hot water supply of 50° C. the reservoir has a capacity of around 10 liters and cools to around 45° C. after 24 hours. Where 7 liters of water is held in the pipe 140 and has cooled to around 15° C., using Equation 1, the minimum temperature of water supplied from the reservoir $T_{min}$ is around 30° C. It should be appreciated that the minimum temperature calculation can only be an approximation as this calculation assumes that the entire volume of cooled water replaces water from the reservoir. Whereas in practice, by virtue of mixing of water in the reservoir, water being drawn from the reservoir will be a mix of water from the reservoir 110 and pipe 140. Further, even if the water temperature approaches the calculated minimum temperature the water temperature does not remain at this temperature due to hot water arriving via the pipe 140 and mixing in the reservoir.

Figure 8:
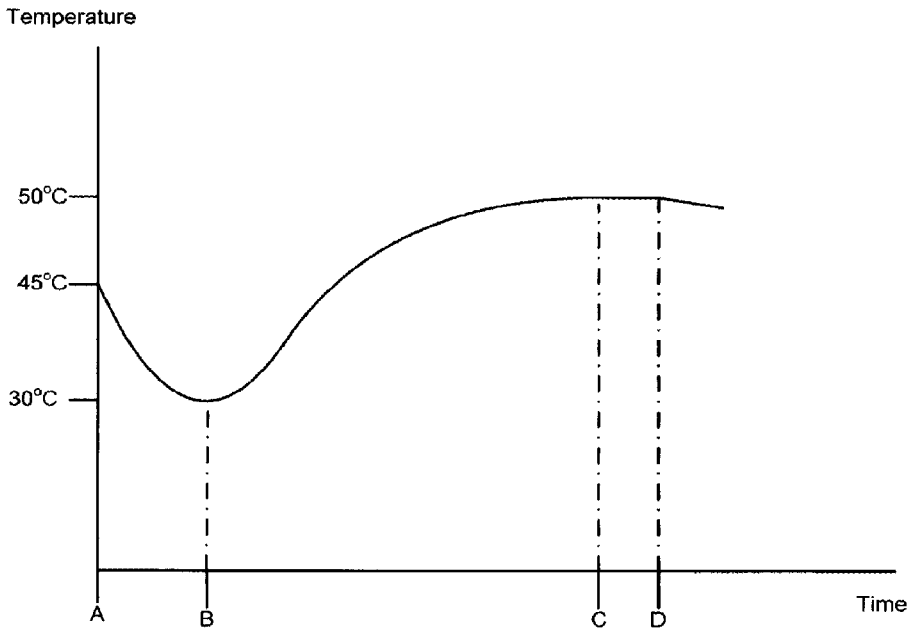
FIG. 8 is a graph of an example of water temperature change in an embodiment.

FIG. 8 shows an example of varying temperature in the reservoir over time based on the above example. Time A represents the time a person turns on the shower with the water in the reservoir at a temperature of 45° C. Between time A and time B cooled water from the pipe 140, at around 15° C., is mixing with water in the reservoir as water is drawn off from the reservoir. Time B represent the time when all the cooled water is flushed from the pipe 140 and fresh hot water, at a temperature of 50° C., arrives at the reservoir 110. Between time B and time C mixing of the fresh hot water with the water in the reservoir causes the temperature in the reservoir to rise until all the water previously stored in the reservoir has been replaced with fresh hot water and the temperature of the reservoir reaches the maximum of 50° C. From time C the person continues showering with the water at a constant temperature of 50° C. until turning off the shower at time D. After time D water stored in the reservoir will cool until the shower is next used, however the rate of cooling of water in the reservoir is much slower than for water in the pipe. It should be appreciated that the minimum temperature in this example represents a worst case scenario and in practice the temperature may not drop to this minimum. For example, depending on the design of the house and plumbing system, water from the pipe 140 may be drawn off upstream of the reservoir 110 at other outlets (say a kitchen or laundry) in between use of the shower, causing heated water to be refreshed in at least part of the pipe 140, reducing the volume of cooled water and/or increasing the temperature of the cooled water mixing in the reservoir 110. The rate of cooling of the water in the pipe 140 is also dependent on many variables, such as the diameter of the pipe, material of the pipe (for example PVC or copper), length of pipe, location of pipe within the building an any insulating effect or lack thereof, and environmental factors such as ambient temperatures. Some of these variables are also pertinent to the rate of heat loss from the reservoir, in particular environmental factors and location of the reservoir, as well as the volume, shape, and insulating properties of the reservoir vessel. Further, factors such as water pressure, pipe diameter and flow rate will also affect the time taken for fresh hot water to reach the reservoir.

The reservoir size is chosen in this embodiment by estimating that this volume of water can be retained in the insulated reservoir 110 at a temperature suitable for showering for at least 48 hours and up to 72 hours. It should be appreciated that the thermal mass of the water stored in the reservoir in combination with the insulation serves to retain heat in this stored water, whereas the water sitting in the uninsulated pipe 140 will rapidly cool. While water is held in the reservoir 110 it will slowly cool and the rate at which the stored water will cool will vary depending on insulation, size and shape of the reservoir vessel.

People typically shower at temperatures around 40° C. but will tolerate a brief drop in water temperature to around 28° C. and 32° C., so even if the water in the reservoir does cool briefly due to mixing with incoming cold water the inconvenience, discomfort and wasted water is significantly reduced compared to having to wait for cold water to be purged from pipes. Typically, showers are utilized every 12 to 24 hours, sometimes more frequently, so cooling of the water in the reservoir may not even be perceptible to the users. Where the capacity of the reservoir is 10 liters this will also be rapidly purged and replaced with freshly heated water in the event that the stored water goes cold, for example after returning from a week away.

Where the maximum reservoir size is not mandated the reservoir size may be selected based on cooling over a 72 hour period to allow for cooling over a long weekend absence. If the reservoir is allowed to cool over a longer period the stored water may be too cold to be used comfortably and in such cases some of the stored water may be wasted. However, it is anticipated that this would be infrequent. Further, not all water in the reservoir would need to be flushed and replaced as hot water from the pipe mixes with cooled water in the reservoir to raise the temperature to a comfortable temperature for showering (between 36° C. and 40° C.) before all water in the reservoir is replaced.

Embodiments of the invention are particularly suited for use with showers because of the typical temperatures and length of time that the hot water is typically flowing. For example what is considered a very short shower is around 3 to 4 minutes but most people prefer to take longer and often households have more than 1 person showering soon after one another. In such situations the reservoir may be completely replenished with freshly heated water during these showers.

Mixing of water within the reservoir 110 may be aided by the geometry of the reservoir and location of the inlet and outlet, some examples will be discussed with reference to FIGS. 2 to 4. In the example of FIG. 2*a*, the reservoir 110 is relatively squat and the inlet 160 and outlet 170 are both located in a lower portion of the reservoir, on opposite sides and water is mixed by virtue of movement of the water through the reservoir from one side to the other and convection. Alternatively the inlet an outlet may be located in the top and bottom of the reservoir. Locating the outlet in the lower portion of the reservoir enables the reservoir to be easily drained empty, if necessary. However, other locations of the outlet are envisaged for example in a central or upper portion of the reservoir. The reservoir may be provided with a secondary outlet for draining, if necessary. For example, in the embodiment shown in FIG. 2*b* the inlet and outlet are both located in an upper portion of the reservoir on opposite sides. Location of the outlet in the upper portion of the reservoir can be advantageous as, when the water is still, thermal convection will result in the warmer water being in upper portion of the reservoir and therefore this warmer water will be first drawn off from the reservoir. Thermal convection will cause cooled water entering the reservoir from the pipe 140 to move toward the lower portion of the reservoir and urge warmer water toward the upper portion causing a mixing action which in turn will aid mixing of heated water with water in the reservoir as water is drawn off. Similarly one or both of the inlet and outlet may be located in a central portion of the reservoir and mixing occurs by virtue of thermal convention and current created by the ingress and egress of water. Embodiments are envisaged where the same reservoir can be installed using different orientations, for example in a upright position the inlet and outlet can be in lower part of the reservoir or in an upside down installation the inlet and outlet are in an upper portion of the reservoir.

Figure 3:
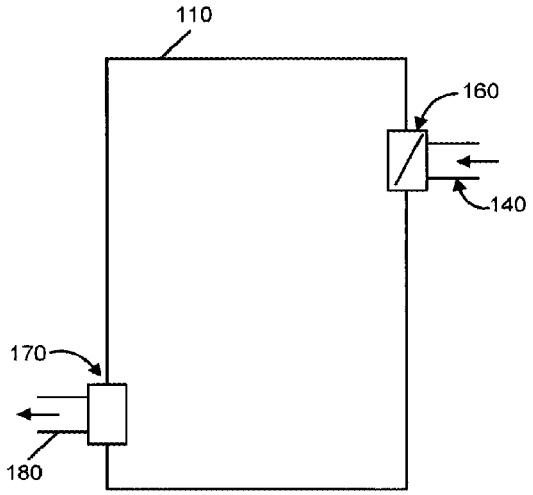

In the example of FIG. 3 the inlet 160 is located in an upper portion of the reservoir 110 and the outlet 170 is located in a lower portion of the reservoir. In this example, mixing of water is again aided by the flow of water through the reservoir and convection. In this example, cold water entering the top of the reservoir 110 via the inlet 160 will be caused by convection to move down through the reservoir to mix with the warmer water before exiting through the outlet 170. Once the water supplied by the inlet 160 is warmer than the water within the reservoir the effect of natural convection results in the warmer water remaining above the cooler water in the reservoir, so the cooler water is released via the outlet 170 and gradually replaced with the warmer water entering the top of the reservoir via the inlet 160.

Figure 4:
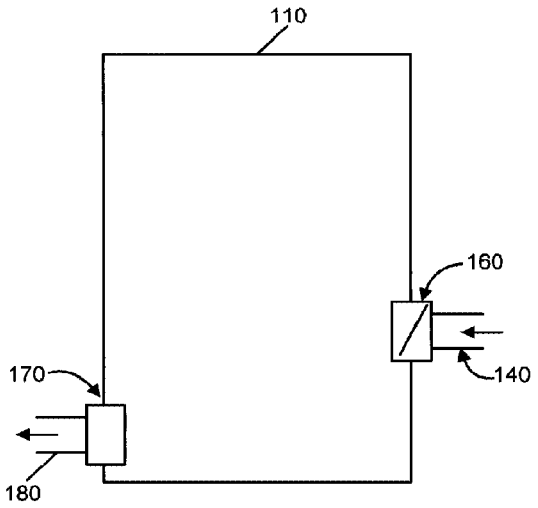

FIG. 4 shows an example similar to that of FIG. 3 which utilises natural convection and movement of the water through the reservoir for mixing, however in this embodiment the inlet 160 is located in the central portion of the reservoir 110. The inlet may also be located in a lower portion of the reservoir. In these examples the outlet is shown in a lower portion of the reservoir but embodiments where the outlet is in a central or upper portion are also envisaged. Irrespective of location of inlet and outlet the temperature of the water in the reservoir equalises as water flows through the reservoir due to the combined effects of currents in the flowing water, pressurisation of the hot water system and thermal convention.

Figure 5:
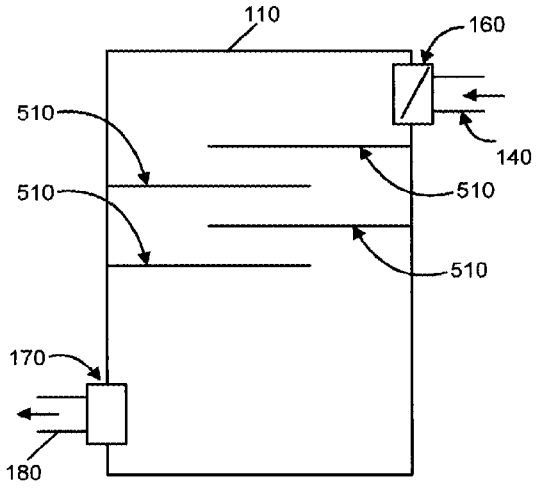

Mixing of water within the reservoir may be aided by the shape of the reservoir vessel itself or internal features within the reservoir vessel. In some embodiments, baffles may be provided within the reservoir 110 to aid mixing of water within the reservoir 110 the baffles are designed to channel the water through the reservoir to aid mixing and can also be arranged to aid flow of water through the reservoir to flush previously stored water from the reservoir as it is replenished with freshly heated water that it is at the optimum temperature. Some non-limiting examples of use of baffles are shown in FIGS. 5 to 7. FIG. 5 shows an example of a reservoir 110 having four internal horizontal baffles to aid mixing of water stored in the reservoir 110 with water supplied via the inlet 160 as it travels through the reservoir to the outlet 170. The baffles 510 may be solid or perforated depending on the embodiment.

Figure 6A:
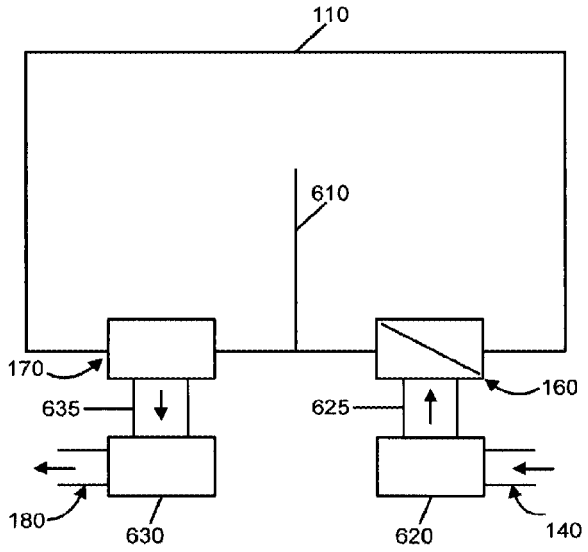
Figure 6B:
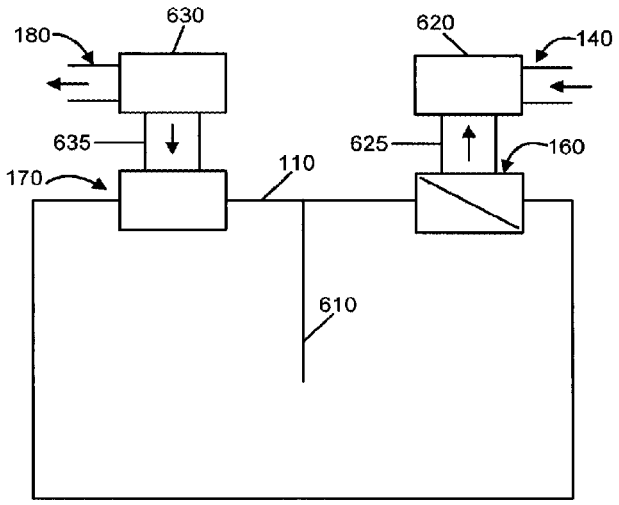
Figure 7:
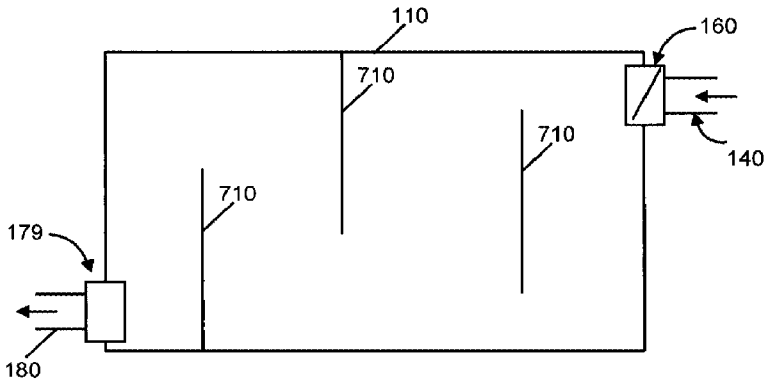

In the example of FIG. 6*a*, the inlet 160 and outlet 170 are both located in the base of the reservoir 110 and a baffle 610 is located between the inlet 160 and outlet 170 to force mixing of the water from the inlet 160 with water in the reservoir 110 before discharge via the outlet 170. This embodiment may be suitable in an application where there is little space for rerouting of pipes or to simplify installation. It should be appreciated that in this example pipes 140 and 180 may initially have been a single hot water supply pipe that has had a section removed and replaced with elbow pieces or stops 620,625 and 630,635 connected to the respective portions of the hot water pipe to divert the flow of hot water via the reservoir 110. Similarly the inlet and outlet may be located in the top of the reservoir, or towards the top of the reservoir with a baffle therebetween to aid mixing of the water in the reservoir. For example, FIG. 6*b* shows an embodiment where both the inlet and outlet are located in the top of the reservoir. Pressurisation of the hot water system enables water to be drawn off the outlet as water flows into the reservoir in this example.

The baffles need not be symmetrically arranged within the reservoir, as shown in the example of FIG. 7, baffles 710 can be arranged in any configuration suitable for encouraging a mixing flow of water from the inlet 160 to the outlet 170. It should be appreciated that any shape orientation or arrangement of baffles is contemplated within the scope of the present invention. It should be appreciated that baffle arrangements may vary with the volume and geometry of the reservoir and the construction of the baffles themselves, for example different size and shape of perforations.

Any arrangement of inlet and outlet position and baffle configuration is envisaged within the scope of the present invention. Other internal structures of the reservoir vessel such as ridges, ribs, waves, contours, waffling or texturing of internal reservoir surfaces may also be used to aid mixing and all such alternatives are considered within the scope of the present invention.

In some embodiments baffles may take the form of internal lattices, ribs or other structure which provide a combined effect of strengthening the reservoir vessel and aiding mixing of water in the reservoir. For example a lattice of interconnected members which add strength to the reservoir vessel may also be arranged to direct flow of water through the reservoir between the inlet and the outlet in a manner that aids mixing, for example a helical structure. In another example baffles for aiding mixing of water may also act as strengthening ribs for the reservoir vessel. All such variations are contemplated within the scope of embodiments of the present invention.

In another set of embodiments a fluid distributor is disposed within the reservoir attached to the inlet so that the inflowing water is dispersed into the reservoir via the fluid distributor rather than directly from the inlet. The fluid distributor can be configured to improve mixing of the fluid within the reservoir. In some embodiments the fluid distributor can be configured to distribute the inflowing water throughout the reservoir from multiple outlets form the fluid distributor, rather than from a single outlet. This will diffuse the incoming water throughout the reservoir to aid mixing. The fluid distributor may also be configured to enable some heat exchange between the stored water and inflowing water before the inflowing water mixes with the water held in the reservoir. The use of a fluid distributor reduces the likelihood of cooled water entering from the inlet and flowing directly to, then out of the outlet still cold without significantly mixing with the stored water. The fluid distributor can help to even out the temperature changes experienced during the initial stages of water flow before the water in the reservoir reaches the hot water service delivery temperature.

Figure 9:
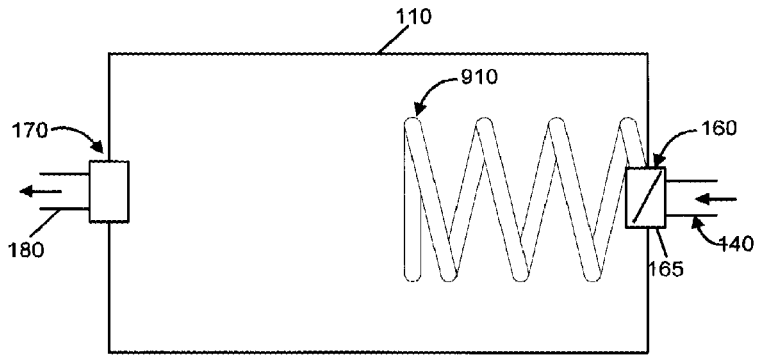
FIGS. 9 to 12 are block diagrams of further embodiments of the present invention.

An example of a first embodiment of a fluid distributor is shown in FIG. 9, where attached to the inlet 160 internal to the reservoir 110 is a helical coil tube 910 through which water flows before being release into the reservoir 110 to mix with the stored water. The helical coil can cause the water to swirl around the reservoir to improve mixing. Further the coil tube 910 can be made from a material, such as copper or aluminium, which enables heat exchange between the fluid in the coil tube and the reservoir before the fluid is released in to the reservoir. In the embodiment shown the coil tube 910 extends about half way into the reservoir, but this may vary between embodiments. For example in an embodiment the inlet and outlet may both be located next to each other in the base of the reservoir 110 with a coil tube fluid distributor attached to the inlet and extending to the top of the reservoir. This allows heat exchange between the inflowing water and the water in the reservoir through the length of the reservoir as the water flows through the coil tube and the inflowing water is release into the reservoir at the top of the reservoir remote form the outlet, so that the inflowing fluid will mix with the stored fluid before flowing from the outlet. The helical coil tube is one example of a fluid distributor, other forms of fluid distributor include but are not limited to pipes or sets of pipes, shell or plate shaped structures, configured to allow fluid to flow in from the inlet and out from one or more apertures in the structure. The number and location of apertures can vary between embodiments. Examples of different fluid distributor examples are shown in FIGS. 9 to 12 however, many alternative structures may be used.

Figure 10:
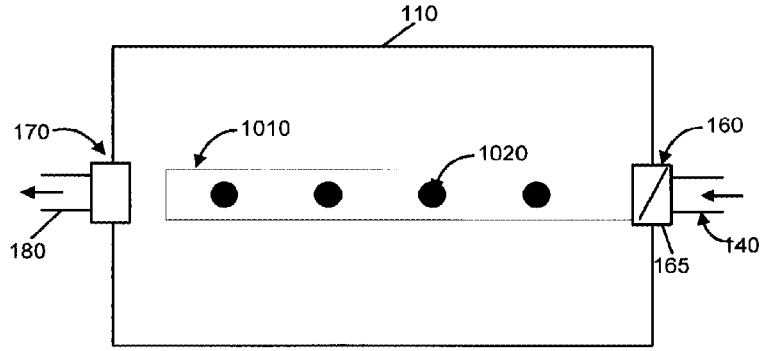
Figure 11:
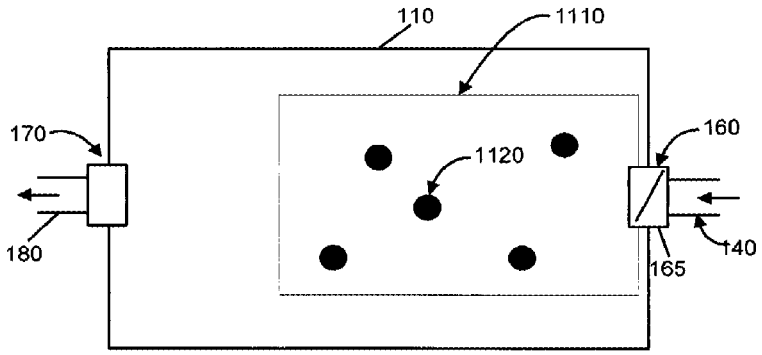
Figure 12:
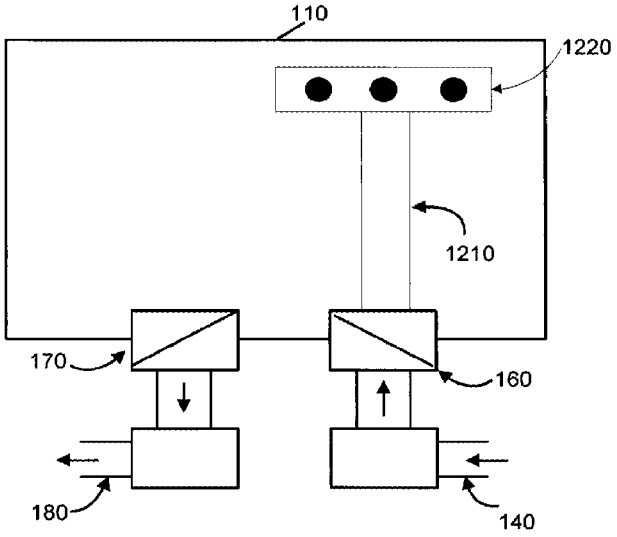

FIG. 10 shows a sparge pipe type fluid distributor, having a pipe 1010 with a plurality of holes 1020 distributed along the length of the pipe 1010 to release fluid from the pipe 1010 throughout the reservoir. This arrangement ensures that there is some mixing of the cooled and stored water before release through the outlet. The number, size and arrangement of holes 1020 along the pipe 1010 can vary between embodiments and any arrangement is considered within the scope of the present invention. FIG. 11 shows an alternative fluid distributor having a wide flat hollow plate shaped structure 1110 with a plurality of holes 1120 in the surface. The fluid distributor is attached to the inlet 160 so fluid flows into the structure 1110 and out through the holes to mix with water in the reservoir. The plate shapes structure may comprise a series of interconnected pipes or internal channels to control fluid flow within the fluid distributor. In an alternative embodiment the fluid dispenser may be a plurality of pipes interconnected in a mesh type structure. FIG. 12 shows yet another fluid distributor embodiment comprising a tube 1210 and diffuser 1220 to release the inflowing water remote from the inlet 160 in an arrangement that enables the inlet and outlet to be placed proximate each other. This arrangement may have advantages for installation of the device because the inlet and outlet are located side by side.

Figure 13:
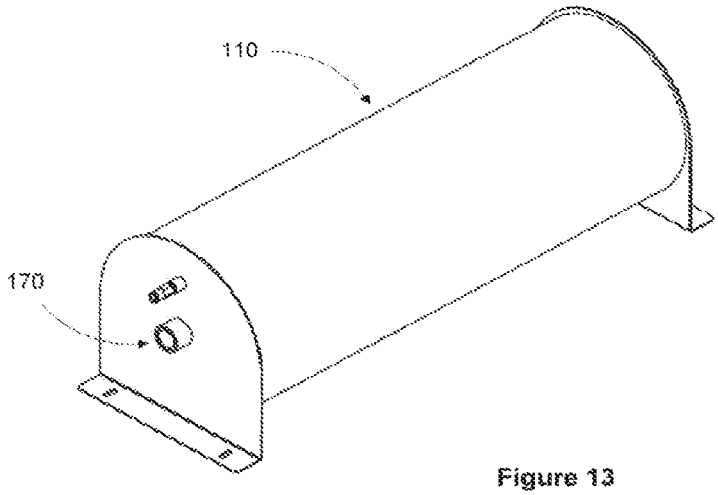
FIG. 13 is an example of an embodiment of the invention.
Figure 14A:
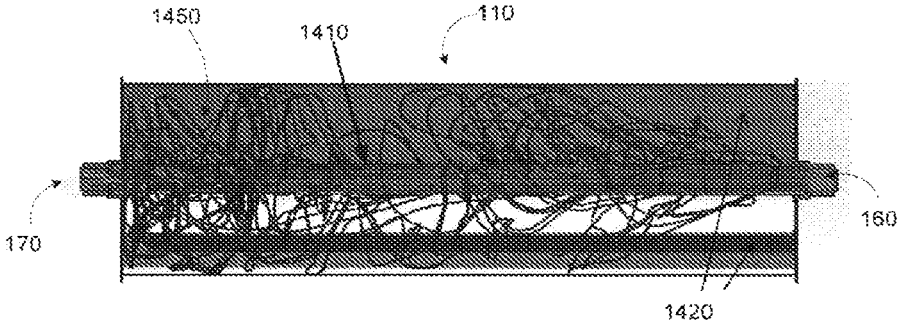
FIGS. 14*a* and 14*b* show a first example of a fluid flow model and fluid distributor.
Figure 14B:
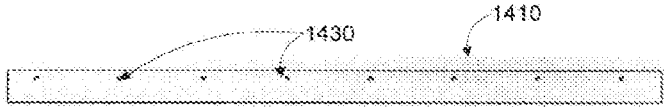
Figure 15A:
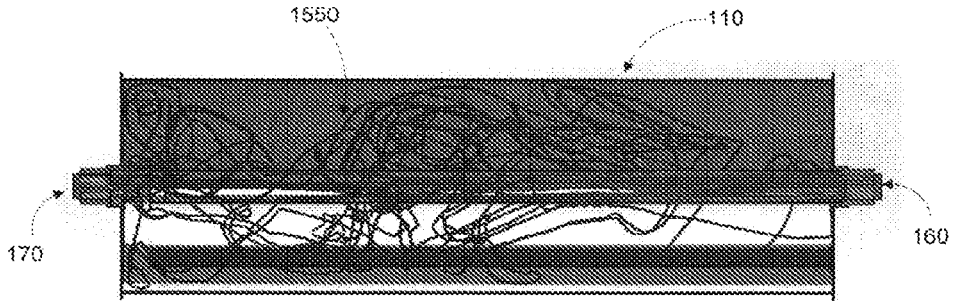
FIGS. 15*a* and 15*b* show a second example of a fluid flow model and fluid distributor.
Figure 15B:
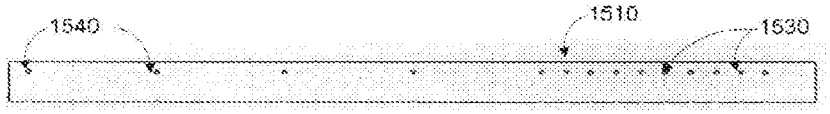
Figure 16A:
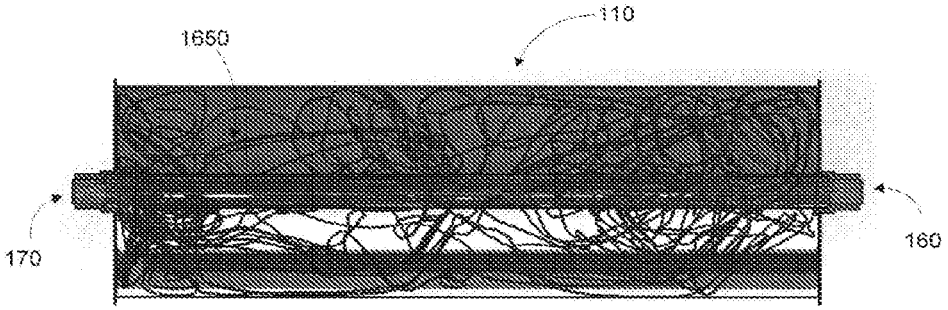
FIGS. 16*a* and 16*b* show a third example of a fluid flow model and fluid distributor.
Figure 16B:
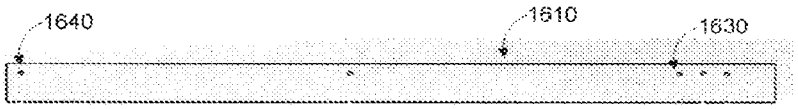

An example of an embodiment is shown in FIG. 13, in this embodiment the reservoir 110 is cylindrical having a volume of approximately 10 liters with an inlet (not shown) and outlet 170 at either end. FIGS. 14*a* and 14*b* show an example of modelled fluid flow in the reservoir 110 for a sparge pipe 1410 having a plurality of holes 1430 along its length. The sparge pipe 1410 is directly connected to the inlet 160 whereby fluid enters the pipe 1410. Fluid flows out of the sparge pipe from the holes 1430 to mix with the fluid in the reservoir 1450 and the mixed fluid flows form the reservoir 110 via the outlet 170. The modelled fluid flow for the fluid entering the reservoir is shown 1450 in FIG. 14*a*. FIG. 14*b* shows the holes 1430 in this embodiment are evenly spaced along the length of the sparge pipe 1410. As can be seen form the fluid flow modelling 1450 in FIG. 14*a* there is more mixing near the outlet 170 end of the reservoir and relatively little mixing in the area 1420 near the inlet 160. FIGS. 15*a* and 15*b* show an alternative embodiment of a sparge pipe 1510 having a larger number of holes 1530 clustered near the inlet 160 end and holes spaced further apart 1540 near the outlet 170 end, and the resulting fluid flow model 1550. FIGS. 16*a* and 16*b* show a further alternative embodiment of a sparge pipe 1610 having fewer holes overall with a few holes 1630 near the inlet 160 and remaining 1640 holes widely spaced towards the outlet 170 and the resulting modelled fluid mixing pattern 1650. FIGS. 14*a*&*b* to 16*a*&*b* illustrate how different mixing results may be obtained from different configurations of the fluid distributor. It should be appreciated that the mixing results achieved can also vary based on fluid flow rate and vessel shape. Further the desired fluid flow patterns may also vary depending on relative location of the inlet and outlet.

Embodiments having more than one outlet are also envisaged. For example, an embodiment for installation in a bathroom may have one outlet to a shower fixture and one outlet to a faucet over a sink or bath. This embodiment may be desirable if there is insufficient space to install a unit for each of the sink and shower. Further as the sink may be used more often during the day than the shower, the heated water in the reservoir may be refreshed more regularly that if used for the shower alone and hence have a higher starting temperature for the next shower. Such an embodiment may use a long narrow cylindrical reservoir body with the outlets located at either end or along the body. A suitably configured fluid distributor may be connected to the inlet to enabling mixing for either outlet. It should be appreciated that in such an embodiment output water pressure may be affected if both the sink and shower are used at the one time if the inflow from the inlet is less that the outflow demand when both outlets are open.

Embodiments of the invention may be used with additional fittings to improve temperature control and convenience for the user. For example the outlet may be connected to a thermostatic mixing valve which includes a water temperature sensor and control mechanism to ensure that water is released at no hotter than a pre-set temperature (for example 40 degrees). The thermostatic mixing valve is connected to a cold water supply and hot water supply from the outlet. When the tap is turned on the thermostatic mixing valve senses the water temperature of the hot water and if this is less than the present limit, flow of water from the cold water supply is inhibited, once the temperature from the outlet reaches the pre-set temperature cold water is allowed to flow at a rate which maintains the output water temperature at the tap at the pre-set temperature.

In some embodiments the inlet and outlet of the reservoir can be configured to minimise heat loss. In some embodiments this comprises insulating the inlet and outlet fittings. Valve configurations, such as double walled valves, check valves having an air evacuated centre, and dual direction check valves can also be used which reduce heat loss from the reservoir even if the valves are not required for water flow control. In some embodiments low thermal transfer materials may be used for connection of a fluid distributor to the reservoir inlet to reduce heat loss via the inlet. In such embodiments a low thermal conductivity material provides a buffer to reduce heat transfer between more highly thermally conductive internal and external components. For example, a high thermal conductivity copper sparge pipe may be connected to the inlet via a section of low thermal conductivity material, such as PVC pipe to reduce heat transfer from water within the reservoir to the inlet, fittings and hot water pipe connected thereto to reduce overall heat loss. Alternatively the fluid distributor may be formed of low thermal conductivity material to reduce heat loss via conductivity to external fittings. In particular for diffuser style fluid distributors, thermal conductivity of the fluid distributor is not necessary. There may also be advantages with regard to production cost, flexibility of fluid distributor configuration and final product weight enabled by the use of materials such as plastics and PVC.

In an embodiment, each of the inlet and outlet may use dual fittings and insulation around the reservoir inlet and outlet to reduce heat loss. In such an embodiment each of the inlet and outlet has an internal and external fitting which include check valves to inhibit flow of water unless the tap/shower is operated. An insulated cavity is provided in the reservoir casing proximate the inlet and outlet, the internal inlet and outlet fittings are connected to the external inlet and outlet fittings via respective lengths of low heat transfer pipe coiled within the insulated cavity. The external fixtures can also include check valves to minimise heat transfer. This configuration provides a buffer zone between the reservoir and the external water pipes to reduce heat loss from the reservoir via the inlet and outlet fittings. Having such a buffer reduces the rate at which heat may be lost from the water stored in the reservoir. Reduction of heat loss may also be achieved by improved insulation of the inlet and outlet fittings and using low heat transfer materials for construction of the fittings.

Figure 17:
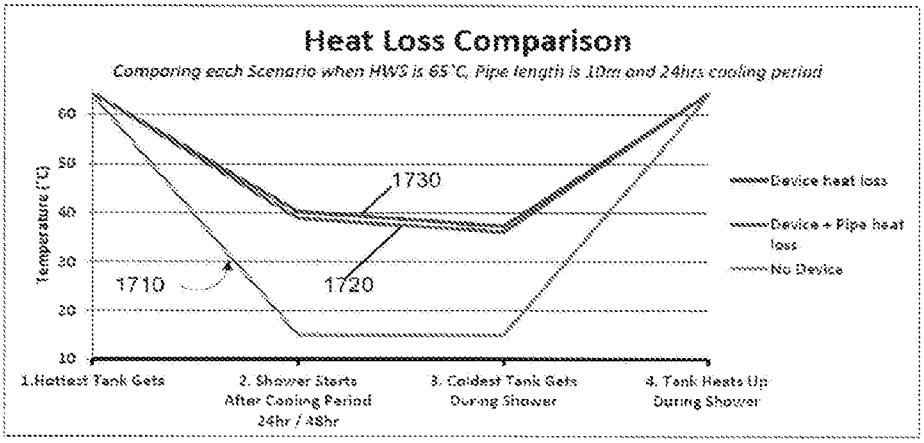
FIG. 17 shows comparative temperature profiles for an embodiment of the present invention and standard hot water supply configuration.

A comparative example of hot water temperatures using an embodiment of the present invention and without is show in in FIG. 17. In this example line 1710 shows the expected temperature for a normal shower where no device in accordance with embodiments of the invention is installed. Line 1720 shows the expected temperature change over time for water pipes and a device of the present invention given the hot water service initial temperature is 65° C., pipe length is 10 meters, and reservoir capacity of 10 liters and the initial cooling period is 24 hours. Line 1730 shows the temperature profile for the reservoir alone. The initial part of the graph represents heat loss over a 24 hour period and it should be appreciated that in this graph the time axes is not to scale. At a time (2) when a person turns on the shower the water in the pipes has cooled to around 15° C. For the embodiment without the device represented by line 1710 the water at the shower stays at this temperature until all the cooled water is purged from the water pipes. With the device installed as represented by lines 1720 and 1730 at the time when the shower is turned on the temperature is around 40° C. and this temperature drops slightly until the time (3) as the cooled water is purged from the water pipes, but only to a temperature of around 36°. The water temperature then rises until the water in the reservoir reaches the temperature of the hot water from the hot water service. As can be seen from the gap between lines 1710 and 1720, the shower temperature can be significantly improved using the device of embodiments of the present invention.

Figure 18:
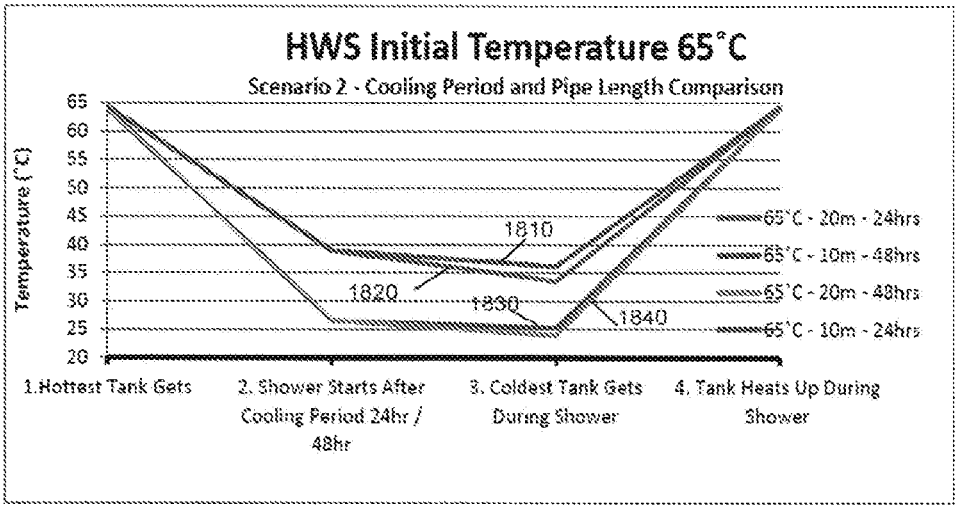
FIG. 18 shows comparative temperature profiles for different installation conditions and cooling times for an embodiment of the present invention.

FIG. 18 shows comparative examples of temperature changes for different configurations and cooling times. The hot water service temperature in these examples is 65° C. The temperature profile represented by line 1810 is for an embodiment where the cooling time is 24 hours and the pipe length is 10 meters, line 1820 represents an embodiment where the cooling time is 24 hours and the pipe length is 20 meters, line 1830 represents an embodiment where the cooling time is 48 hours and the pipe length is 10 meters, and line 1840 represents an embodiment where the cooling time is 48 hours and the pipe length is 20 meters. As can be seen from the gap between lines 1810 and 1830 the most significant influence on the output water temperature is cooling time. However, comparing the results from FIG. 17 and FIG. 18 show that the lowest temperature for the worst case scenario shown 1840 using the device with 20 meters of pipe and a 48 hour cooling period, the shower water only drops to around 24° C., compared to 15° C. without the device. It should be appreciated that these calculated results may vary depending on the reservoir size, quality of insulation and ambient temperatures.

Embodiments of the present invention may be installed with existing hot water systems in a manner that requires minimal re-plumbing and no modification to the existing hot water system. The volume and geometry of the reservoir 110 may be selected based on the distance from the main hot water supply tank and space available for the reservoir. Thus, many different shapes and sizes of reservoirs may be provided. The examples given above and in the accompanying drawings are non-limiting illustrative examples.

Additional features of the reservoir may include pressure release valves, draining/spill pans and additional outlets for draining. Inclusion of such additional features may be mandated in some areas by building codes or regulations. In other areas these may be optional features. Any combination of such optional features is envisaged within the scope of the present invention.

Embodiments of this water saving apparatus are passive requiring no sensors or electronic components for operation. It should therefore be appreciated that minimal or no maintenance is required and there is no standby running cost. A further advantage of the use of this invention is an effective increase in hot water storage as heated water is now stored both in the tank of the hot water system 120 and the reservoir 110. Typically, it takes a hot water system 120 some time to heat a full tank and it is possible for the heated water of the hot water system 120 to be exhausted during a period of high use, for example, in larger households or if guests increase the number of people showering.

The above examples all describe using the invention in conjunction with showers as this is a highly suitable and preferred application. However the invention may also be used in other applications such as sinks or in laundries.

It will be understood to persons skilled in the art of the invention that many modifications may be made without departing from the spirit and scope of the invention.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A water saving apparatus for use with a hot water system, the apparatus being sized and shaped for installation proximate one or more water outlet fixtures for delivery of heated water from the hot water system for use, the apparatus comprising:

an insulated reservoir having an inlet and an outlet, the inlet being arranged to be connectable to a hot water pipe which carries heated water from the hot water system and the outlet arranged to be connectable to a hot water pipe providing heated water to the one or more water outlet fixtures to enable the reservoir to be installed in line with the flow of heated water from the hot water system to the one or more fixtures to store a quantity of heated water whereby water that has cooled in the hot water pipe between the hot water system and the reservoir mixes with the stored heated water in the reservoir as water flows from the hot water system to the water outlet fixture; and one or more structures arranged inside the reservoir to aid mixing of water entering the reservoir via the inlet with water in the reservoir before release through the outlet.

2. The apparatus as claimed in claim 1 wherein the at least one of the one or more structures is a fluid distributor connected to the inlet to allow fluid to flow therethrough and configured to control entry of water from the inlet into the reservoir.

3. The apparatus as claimed in claim 2 wherein the fluid distributor is configured to enable some heat exchange between the water flowing therethrough and the water in the reservoir before the water entering the reservoir mixes with the water in the reservoir.

4. The apparatus as claimed in claim 3 wherein the fluid distributor is configured such that water flowing therethrough enters the reservoir remote from the outlet.

5. The apparatus as claimed in claim 2 wherein the fluid distributor is configured to disperse the inflowing water throughout the reservoir.

6. The apparatus as claimed in claim 5 wherein the fluid distributor comprises a body for water to travel therethrough, the body having a plurality of apertures to allow water to be released into the reservoir.

7. The apparatus as claimed in claim 6 wherein the body is an elongate pipe with apertures distributed along the length of the pipe.

8. The apparatus as claimed in claim 7 wherein the apertures are distributed asymmetrically along the length of the pipe.

9. The apparatus as claimed in claim 5 wherein the fluid distributor comprises a plurality of interconnected pipes.

10. The apparatus as claimed in claim 2 wherein a low heat conductivity material is used for the connection of the fluid distributor to the inlet.

11. The apparatus as claimed in claim 1 wherein the one or more structures include baffles.

12. The apparatus as claimed in claim 11 wherein the baffles are perforated.

13. The apparatus as claimed in claim 1 wherein the inlet and outlet are provided with insulated connecting fixtures to reduce heat loss from the reservoir.

14. The apparatus as claimed in claim 1 wherein the inlet and outlet are provided with dual component fittings, each comprising a proximate component for respective connection to the reservoir, and a distal component for connection to the respective hot water pipe or water output pipe, the connection between the proximate and distal components of the fittings being insulated and configured to inhibit water flow between the reservoir and external pipes in the absence of water flow from the water outlet fixture.

15. The apparatus as claimed in claim 1 wherein and at least the inlet has a one way valve arranged to allow water to flow into the reservoir and inhibit reverse flow of water from the reservoir to the hot water pipe.

16. The apparatus as claimed in claim 1 wherein the inlet is adjacent to the outlet.

17. The apparatus as claimed in claim 16 wherein both the inlet and outlet are located in a lower portion of the reservoir.

18. The apparatus as claimed in claim 1 wherein the reservoir is cylindrical.

19. The apparatus as claimed in claim 1 further comprising any one or more of: a pressure release valve, a spill pan, or an additional drainage outlet.

20. A water saving apparatus for use with a hot water system, the apparatus being sized and shaped for installation proximate one or more water outlet fixtures for delivery of heated water from the hot water system for use, the apparatus comprising:

an insulated reservoir having an inlet and an outlet;

the inlet being arranged to be connectable to a hot water pipe which carries heated water from the hot water system and the outlet arranged to be connectable to a hot water pipe providing heated water to the one or more water outlet fixtures to enable the reservoir to be installed in line with the flow of heated water from the hot water system to the one or more fixtures to store a quantity of heated water whereby water that has cooled in the hot water pipe between the hot water system and the reservoir mixes with the stored heated water in the reservoir as water flows from the hot water system to the water outlet fixture, the inlet being arranged adjacent to the outlet, the inlet and outlet having insulated connecting fixtures to reduce heat loss from the reservoir, and at least the inlet having a one way valve arranged to allow water to flow into the reservoir and inhibit reverse flow of water from the reservoir to the hot water pipe, and one or more structures arranged inside the reservoir to aid mixing of water entering the reservoir via the inlet with water in the reservoir before release through the outlet.

* * * * *